US005222668A

United States Patent [19]

Frankeny et al.

[11] Patent Number: 5,222,668

[45] Date of Patent: Jun. 29, 1993

[54] FLUID ACTUATED CONNECTOR

[75] Inventors: Richard F. Frankeny; Karl Hermann, both of Austin; Ronald E. Hunt, Georgetown; Verlon E. Whitehead, Austin, all of Tex.

[73] Assignee: International Business Machines Corporation, Armonk, N.Y.

[21] Appl. No.: 679,899

[22] Filed: Apr. 3, 1991

[51] Int. Cl.[5] ..... H01R 13/00

[52] U.S. Cl. ..... 439/197; 439/493

[58] Field of Search ..... 439/197-201, 439/260, 265, 493

[56] References Cited

U.S. PATENT DOCUMENTS

| | | | |
|---|---|---|---|
| 2,636,068 | 4/1953 | Perkins | 173/328 |
| 2,956,258 | 10/1960 | Raddin | 339/75 |
| 2,978,666 | 4/1961 | McGregor | 339/17 |
| 3,076,166 | 1/1963 | Raddin | 339/17 |
| 3,090,026 | 5/1963 | Raddin | 339/17 |
| 3,594,707 | 7/1971 | Peterson | 339/17 L |
| 4,220,389 | 9/1980 | Schell | 339/74 R |
| 4,968,265 | 11/1990 | Fox, Jr. | 439/197 |

FOREIGN PATENT DOCUMENTS 3621064 1/1988 Fed. Rep. of Germany .

OTHER PUBLICATIONS

IBM Technical Disclosure Bulletin, "Electrical Connector with Cam Action," vol. 12, No. 11, Apr. 1970, pp. 1741-1742.

*Primary Examiner*—Joseph H. McGlynn
*Attorney, Agent, or Firm*—Mark E. McBurney

[57] ABSTRACT

A fluid actuated connector is provided with opposing circuit members that form the interior of the connector and which are substantially L-shaped with a substantially vertical portion facing a circuit card to be inserted into the connector and a substantially horizontal portion disposed onto a printed circuit board (PCB), such as a motherboard, or the like. The circuit members are disposed adjacent a frame and connector body such that a cavity is formed adjacent the circuit members and on a side opposite the electrical connection points being being contacted with the printed circuit card. The circuit membranes are formed of a single layer of dielectric material, to maintain the required resiliency, and have contacts, which may be in the form of "bumps" etched into an electrically conductive material applied to the surface of the dielectric facing the circuit card. The side of the circuit membrane in communication with the cavity, which is filled with a non-compressible fluid, receives the force that deforms the circuit membrane. In order to increase the force actually transferred to the contact bumps, rigid pads are placed on the inside of the circuit membrane such that the pressurized fluid acts directly on the rigid pads. These pads are etched into a metal layer deposited on the dielectric and placed substantially opposite the electrical contact bumps, thereby allowing transfer of the force from the fluid directly to the bumps without the intermediate layers of an expandable tube, bladder, or the like.

10 Claims, 5 Drawing Sheets

FLUID ACTUATED CONNECTOR

BACKGROUND OF THE INVENTION

1. Field of the Invention

The present invention relates generally to fluid actuated connectors, and in particular to fluid connectors used in connecting printed circuit cards to printed circuit boards, such as a motherboard, the like capable of use in a computer product, such as a personal or mainframe computer.

2. Description of Related Art

Fluid actuated electrical connectors are well known in the art for providing force between contacts to allow for electrical connection. For example, U.S. Pat. No. 3,594,707 describes a fluid pocket with a flexible conductor supporting material having an insert strip conductor bonded thereto. The conductor supporting material expands in response to fluid pressure and provides contact between the insert strip and a spring connector. U.S. Pat. Nos. 2,956,258; 3,076,166; and 3,090,026 all describe a discrete fluid filled flexible bag, actuated by a screw compression device, which expands and contacts printed circuit cards, thereby forcing them into an electrically connecting relationship. U.S. Pat. No. 4,220,389 discusses a zero insertion force connector wherein an expandable tube runs parallel with contact surfaces and relieves the tension of a contact spring when expanded, thereby allowing a circuit card to be inserted into the connector. Upon deflation of the tube, the spring biases the contact surfaces towards the card making an electrical connection therebetween. U.S. Pat. No. 4,968,265 also describes various configurations utilizing discrete bladders and expandable tubes to effect connections between electrical contacts. Another U.S. Pat. No. 2,978,666 utilizes a flexible tube, doubled in half, thereby forming two parallel legs, having a row of contacts in between. A circuit card is then inserted intermediate the contacts and the tube is expanded which constrains the contacts against conductor strips of the printed circuit card. Finally. U.S. Pat. No. 2,636,068 and German Patent DE 3621064 A1 show connectors using a flexible bladder like member to effect electrical connection between contacts.

It can be seen that each of these references utilize a discrete component which is used to force an adjacent contact into an electrically contacting relation with another contact, circuit card, or the like. Conversely, none of the above cited art shows a single electrical/mechanical element which not only responds to fluctuations in fluid pressure, but also exhibits the electrical characteristics which match the printed circuit card being connected, i.e. controlled characteristic impedance, noise coupling coefficient, independent power connections with low inductance, etc.

Further, from a manufacturing point of view, it would be desirable to be able to fabricate this electrical circuit element membrane at the same time and with the same processes as the circuit card being inserted into the connector. Additionally, it would also be advantageous to eliminate the need for a mechanical element, e.g. discrete bladder, to provide force to a separate electrical element. The elimination of a component of the connector and the problems associated with manufacturing, and maintaining the mechanical element under pressure will provide a more reliable connector system. By elimination of the mechanical element a more uniform pressure is brought to bear on the electrical element, since a resilient layer between the pressurized fluid and the electrical contact being displaced is removed.

For these reasons, it can be seen how a single resilient electrical membrane utilized in a fluid connector is desirable.

SUMMARY OF THE INVENTION

In contrast to the prior art, the present invention provides a high contact pressure, fluid actuated connector having a single component which provides the electrical circuit contact, and required mechanical characteristics. In this manner, the intermediate layer of a resilient bladder, or the like is eliminated such that the actual fluid pressure is brought to bear on the electrical member.

Broadly, opposing circuit membranes form the interior of the connector and are substantially L-shaped with a substantially vertical portion facing the circuit card to be inserted into the connector and a substantially horizontal portion disposed on to the printed circuit board (PCB). such as a motherboard, or the like. The circuit membranes are disposed adjacent a frame and connector body such that a cavity is formed adjacent the circuit membranes and on a side opposite the electrical connection points being contacted with the printed circuit card.

The circuit membranes are formed of a single layer of dielectric material, to maintain the required resiliency, and have contacts, which may be in the form of "bumps" etched into, or deposited on an electrically conductive material which is applied to the surface of the dielectric that faces the circuit card. The side of the circuit membrane in communication with the cavity, which is filled with a non-compressible fluid, receives the force that deforms the circuit membrane. In order to increase the force actually transferred to the contact bumps, rigid pads are placed on the inside of the circuit membrane such that the pressurized fluid acts directly on the rigid pads. These pads are etched into a metal layer applied to the dielectric and placed substantially opposite the electrical contact bumps, thereby allowing transfer of the force from the fluid directly to the bumps without the intermediate layers of an expandable tube, bladder, or the like.

In accordance with the previous summary, objects features and advantages of the present invention will become apparent to one skilled in the art from the subsequent description and the appended claims taken in conjunction with the accompanying drawings.

DETAILED DESCRIPTION OF THE PREFERRED EMBODIMENTS

Figure 1:
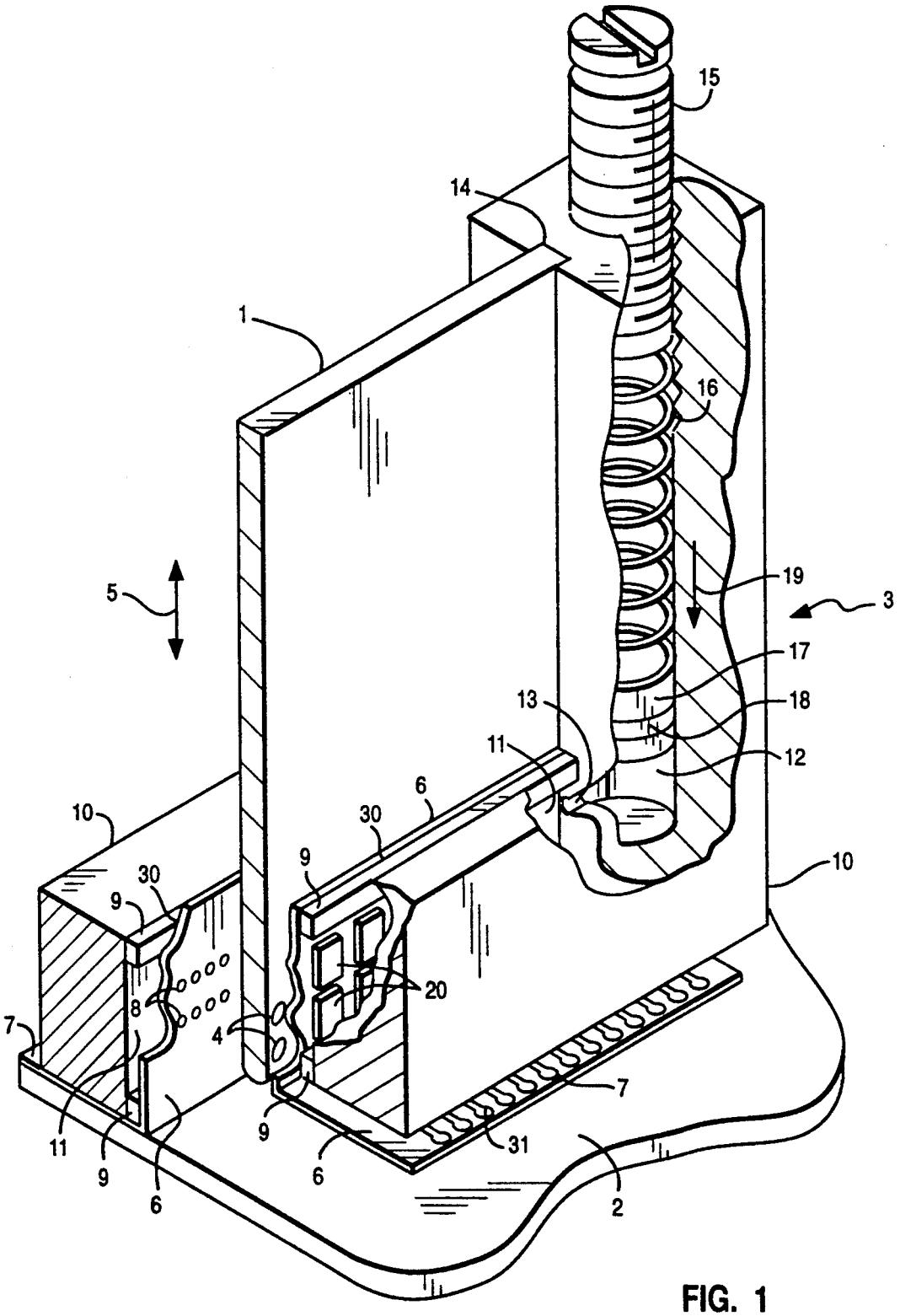
FIG. 1 is a perspective view of the fluid actuated connector of the present invention, showing the deformable circuit membrane and rigid pads for transferring the force from the pressurized fluid to the electrical contacts.

Referring to FIG. 1, which is a perspective view of the connector of the present invention, there is shown a pluggable circuit board 1 which includes a plurality of lands 4 thereon. In a preferred embodiment, these connecting lands 4 are disposed on each side of circuit board 1 and are configured as a dimple in a manner as discussed in U.S. Pat. No. 5,121,299, herein incorporated by reference. The main circuit board 2 is shown on which the connector assembly is rigidly affixed and is generally referred to by reference numeral 3. By way of example, and not of limitation connecting lands 4 are shown in two rows on each side of the circuit board 1 and will correspond with contact points 8 of connector assembly 3 in a manner as described below. Further, it can be understood how circuit board 1 is pluggable into connector assembly 3 in direction of arrow 5.

Expandable circuit membranes 6 are shown in a substantially "L" shape configuration. Individual connection lands 31 on circuit membranes 6 are rigidly electrically connected to main circuit board 2 at end 7 thereof by conventional means such as soldering, or the like. In FIG. 1, lands 31 are visible due to the substantially transparent nature of the material used to fabricate membrane 6, in the preferred embodiment, It will be understood that lands 31 are in electrical contact with connection points (not shown) on main circuit board 2. It can be seen that end 7 of circuit membrane 6 lies adjacent to main circuit board 2 and is shown in a substantially horizontal position in FIG. 1. Of course, main circuit board 2 can be disposed in any position with end 7 and connector 3 disposed adjacent thereto. For the purposes of this example, end 7 will be considered in a substantially horizontal position and end 30 of membrane 6 will be considered in a substantially vertical position. With regard to end 30 of circuit membrane 6, electrical contacts 8 are formed thereon and preferably are configured as bumps or projections. It can be seen that these projections 8 will be aligned with a corresponding connecting land 4 (dimple) disposed on pluggable circuit board 1. In this manner, electrical connection is made from main circuit board 2 through the soldered connections of lands 31 at end 7 of membrane 6, to projections 8 and connecting lands 4 of circuit board 1, which are preferably configured as a dimple.

Circuit membrane 6, which will be described in more detail below, is glued or otherwise affixed to a frame member 9 and sealingly engaged therewith to provide a fluid tight seal. A connector body 10 is provided which forms a housing that surrounds the inner surface of membrane 6 (the side of circuit membrane 6, opposite of circuit board 1) and creates a cavity 11 therebetween which is filled with an incompressible fluid. A second cavity 12 is formed in body 10 and is in communication with cavity 11 through a connecting via hole 13 such that force can be applied and transmitted to the incompressible fluid contained within cavity 11.

Rigid pads 20 are provided on the fluid side (adjacent cavity 11) of circuit membrane 6 and are utilized to amplify the force exerted, from pressurized fluid within cavity 11, on projections 8 such that circuit membrane 6 will only contact the lands 4 of pluggable circuit board 1 through these projections 8. It can be seen, that the shape and size of rigid pads 20 and their location relative to the projections 8 can be individually varied to ensure that the fluid pressure is optimally transmitted as a resultant force through projections 8 to engage lands 4 of circuit board 1. Further, it should be understood that pads 20 may not be totally rigid, but merely more rigid than the remaining portions of membrane 6. In this manner, pads 20 will slightly deform upon the application of pressurized fluid such that stress fractures, or the like will not occur in pads 20 at the point opposite projection 8 where the force is concentrated.

In order to provide the required pressure to the incompressible fluid within cavity 11, the upper end of cavity 12 (which is preferably substantially cylindrical) is threaded such that a screw 15 can be threadedly engaged therewith. A piston 17 is disposed within cavity 12 and has an o-ring seal 18, or the like therearound which forms a sealing relation with the inner wall of cavity 12. Biasing means 16 such as a spring, is disposed intermediate of screw 15 and piston 17. Therefore, as screw 15 is turned and moves downwardly, in a direction of arrow 19, spring 16 compresses and forces piston 17 and o-ring 18 downwardly also in the direction of arrow 19. This downward compression of piston 17 creates a pressure in the fluid contained in cavity 11, thereby deforming circuit membrane 6 outwardly away from cavity 11 and towards pluggable circuit board 1 such that bumps 8 are in electrical engagement with lands 4 thereon. Thus, it can be seen that to provide electrical connection between circuit boards 1 and 2, circuit board 1 is first guided into connector assembly 3 via slot 14 such that it is disposed between the two ends 30 of flexible circuit 6. Slot 14 also ensures that proper alignment of circuit board 1 with flexible membranes 6 will be accomplished. Once circuit board 1 is properly positioned between membranes 6, screw 15 is turned, thereby compressing spring 16 and forcing piston 17 in the direction of arrow 19, and thus creating a pressure in the fluid in cavity 11. Force due to this pressure is then transmitted to projections 8 via pads 20. To remove pluggable circuit board 1 from connector assembly 3, the previous procedure is reversed and screw 15 is turned such that travel will occur in a direction opposite arrow 19. Since compression spring 16 is connected to screw 15, plunger 17 will also travel in a direction opposite arrow 19. It can be seen that movement in the direction opposite arrow 19 by plunger 17 will relieve the compression of spring 16 and create a vacuum in cavities 11 and 12. By evacuating cavity 11, circuit membrane 6 is withdrawn from engagement with pluggable circuit board 1 which can now be removed from connector assembly 3.

Figure 2:
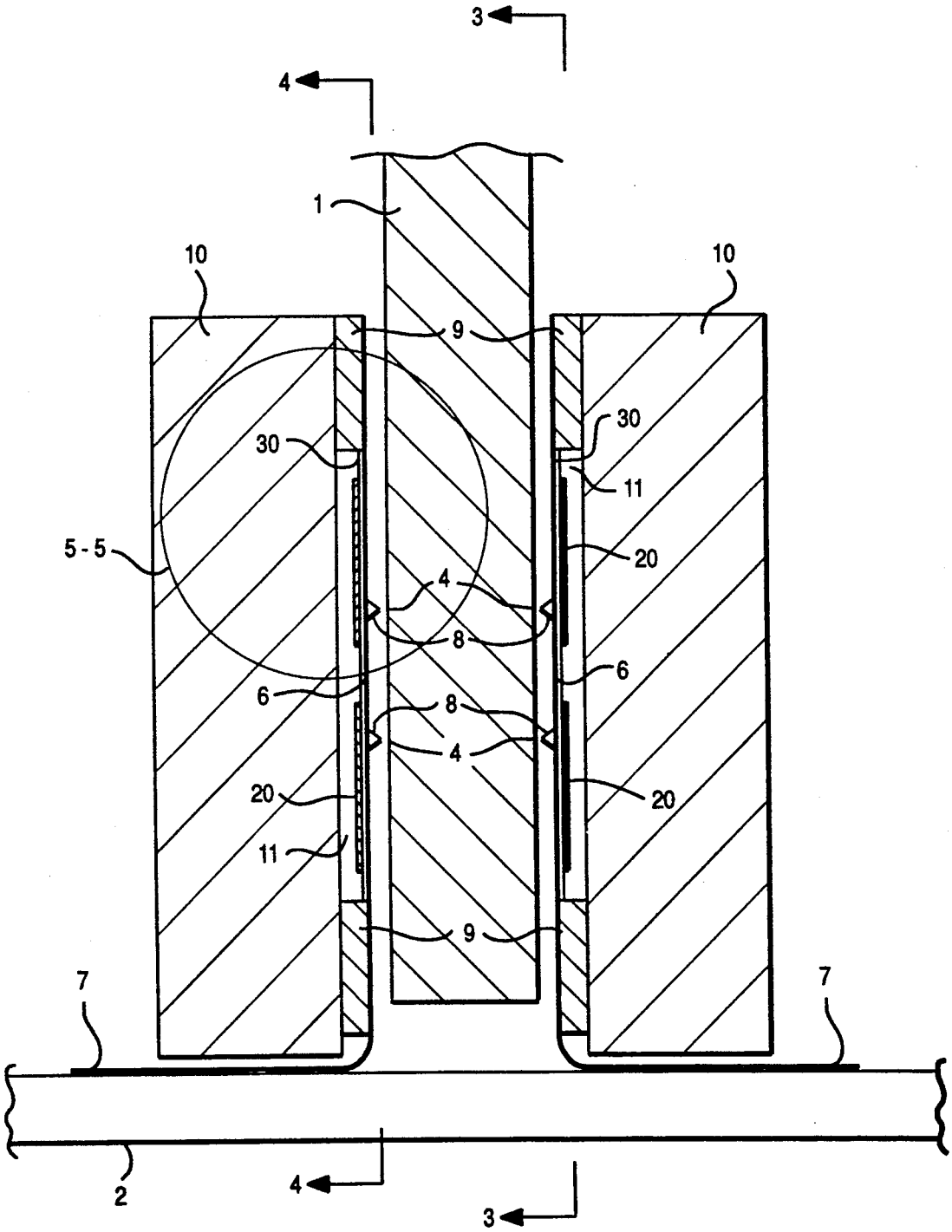
FIG. 2 is a crossectional view of the connector, illustrating the circuit members and their relation to a printed circuit card.

FIG. 2 is a front elevational view of the connector assembly 3 of the present invention with pluggable circuit board 1 shown inserted therein. Main circuit board 2 can be seen with ends 7 of circuit membrane 6 adjacent thereto. Further, frame 9 is shown in conjunction with housing 10 and forms cavity 11 along with circuit membrane 6. It can be seen how end 30 of membrane 6 is adjacent frame 9 and forms a sealing relation therewith by conventional means, such as gluing, or the like. Additionally, circuit membrane 6 also forms a sealing relation with the lower portions of frame 9 thereby maintaining fluid pressure within cavity 11. Rigid pads 20 are shown on the fluid side of membrane 6 substantially opposite projections 8 and in communication with cavity 11 such that the force provided by the pressurized fluid therein will be directly transferred to projections 8. It can be seen that contacts 4 of pluggable circuit board 1 are in alignment with projections 8 such that upon deformation of membrane 6, in response to fluid pressure within cavity 11, electrical contact will be made between contact lands 4 of circuit board 1 and projections 8 of membrane 6.

Figure 3:
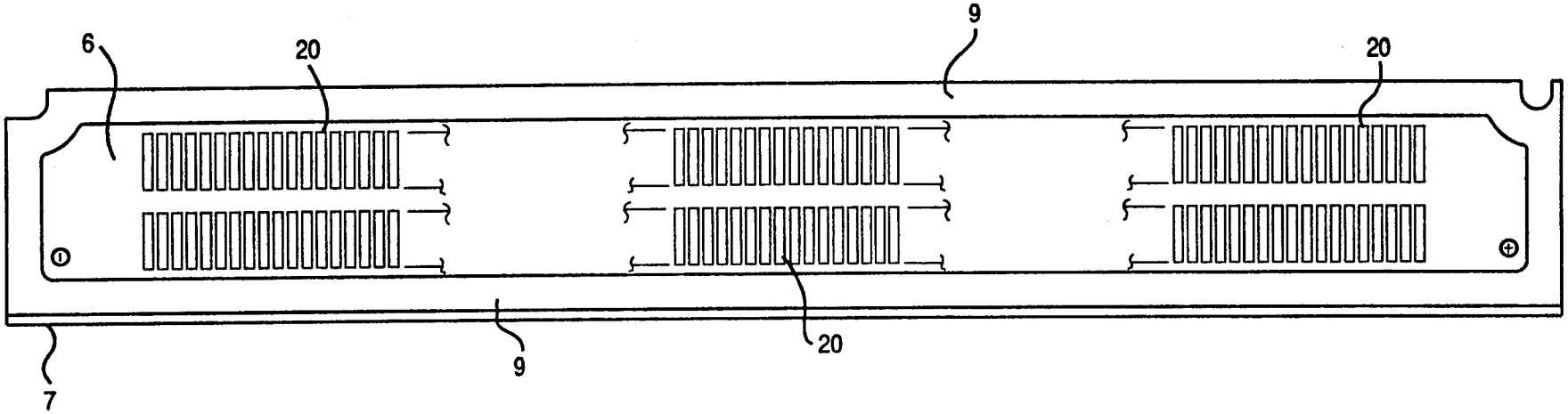
FIG. 3 is a side view, taken along line 3—3 of FIG. 2, of the circuit member showing the rigid pads affixed thereto.

FIG. 3 is a back view of membrane 6 as will be presented to cavity 11, taken along line 3—3 of FIG. 2. A plurality of rigid pads 20 can be seen each corresponding to a projection 8 on the opposite side of membrane 6. Frame 9, as well as end portion 7 of membrane 6 can also be seen. It will be understood how the pressure exerted on the surface area of rigid pads 20 will be transferred to a single point, i.e. projection 8 on the other side of membrane 6. Further, it can be seen that the surface area of projection 8 is much smaller than the surface area of rigid pads 20 such that the pressure as a function of surface area (pounds per square inch) will be much greater. Therefore, extremely high contact pressure is exerted by projection 8 onto land 4 of pluggable circuit board 1, due to the addition of rigid pads 20. It will be understood that high contact pressure is desirable in the electrical connection of circuit boards, or the like since oxide material may be deposited on electrical contacts and high contact pressure will pierce any oxide material which may be present.

Figure 4:
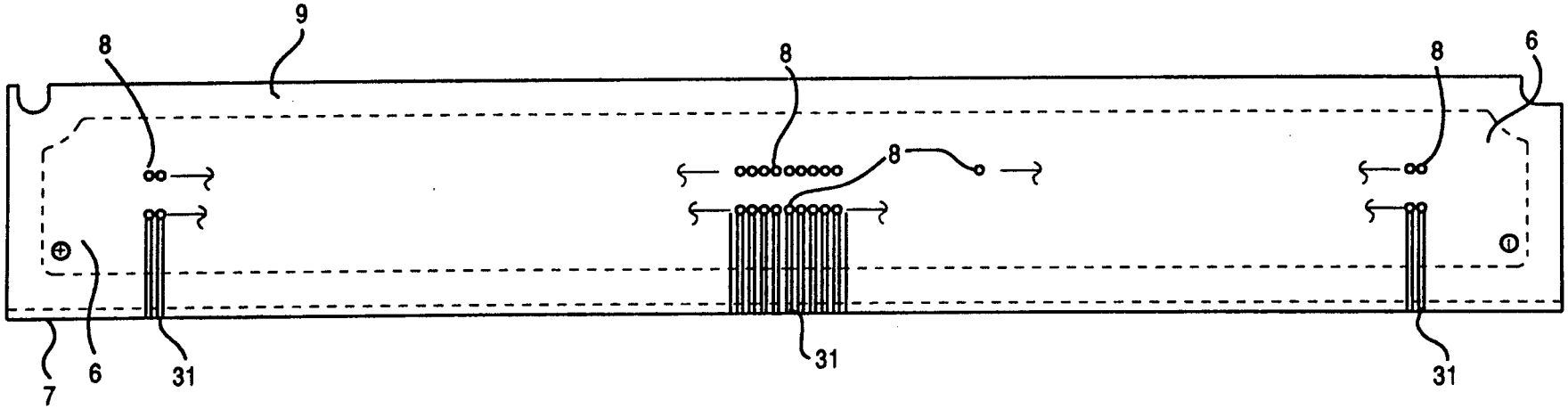
FIG. 4 is a side view taken along line 4—4 of FIG. 2, of the circuit member that contacts the printed circuit card.

FIG. 4 shows the inside of circuit membrane 6, taken along line 4—4 of FIG. 2, which will make the actual contact with pluggable circuit board 1. Again, frame 9 is shown with membrane 6 sealingly affixed thereto. End portion 7 of membrane 6 can also be seen in FIG. 4. In the preferred embodiment, two rows of projections 8 are shown extending substantially the entire length of membrane 6. Lands 31 are shown which provide electrical connection from projection 8 to the end portion 7 of membrane 6 such that affixation can be made to main circuit board 2 by soldering or the like, as previously described with reference to FIG. 1. Of course, any configuration of projections 8 and lands 31 can be utilized to provide electrical contact between pluggable circuit card 1 and main circuit board 2. In a preferred embodiment, projections 8 corresponding to signal interconnections are formed in one row and are on 20 mil center to center spacing, which yields 50 signal lines per inch. Power and reference connections are then placed in another row and configured as needed depending on the particular design. It can be seen that separating signal and power connections will reduce problems associated with noise, and the like. Although not shown, the top row of projections 8 also include lands for connections to end portion 7 of membrane 6. The lands connecting the top row of projections 8 run intermediate to lands 31 as shown in FIG. 4. Thus, it can be seen that when pressure is exerted on membrane 6 from cavity 11, projections 8 will be deformed outwardly to contact lands 4 of circuit board 1.

Figure 5:
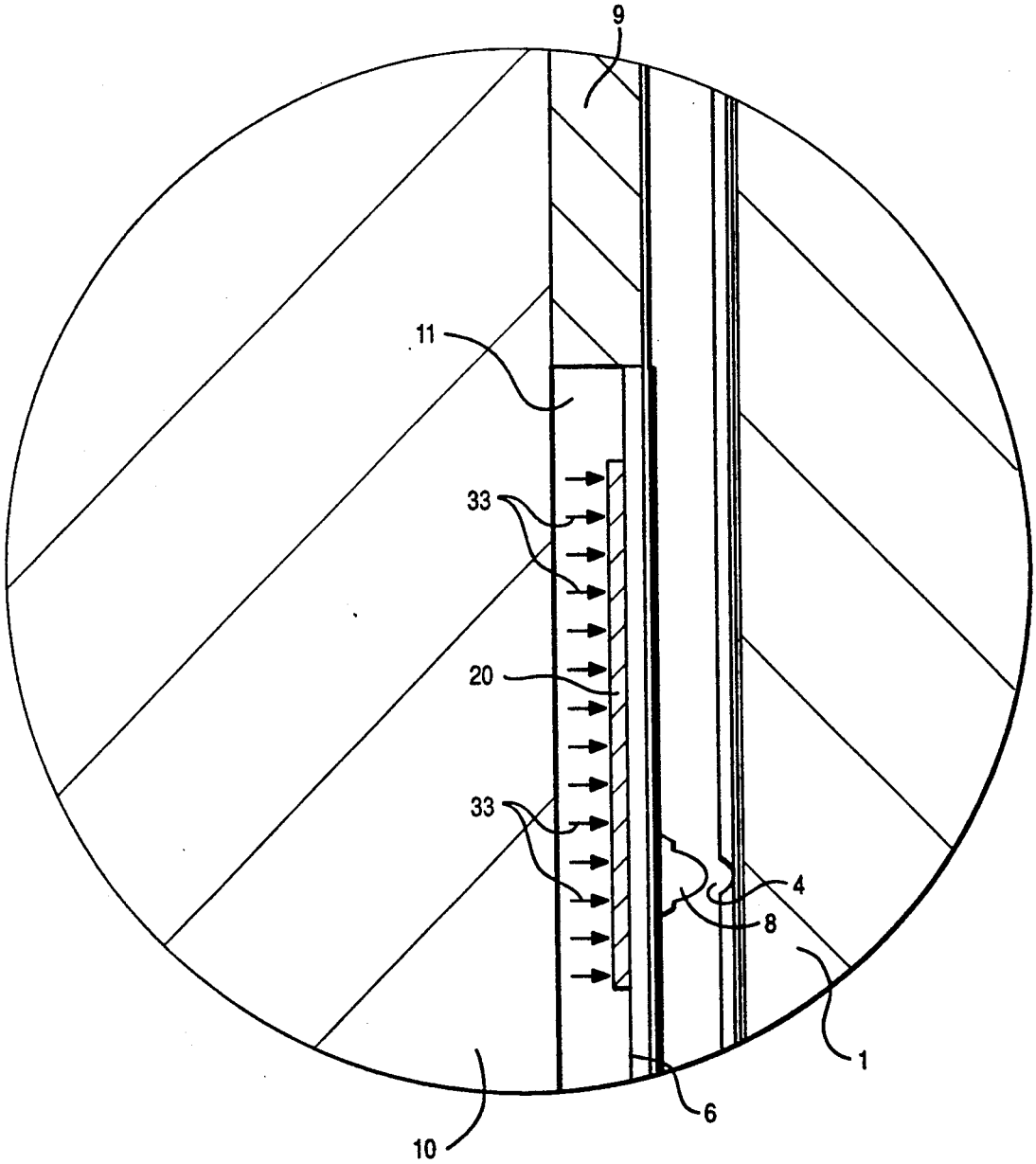
FIG. 5 is a detailed view of the interconnection between the printed circuit card and the circuit member of the connector of the present invention.

FIG. 5 is a detailed view of projection 8 and rigid pads 20 as taken from FIG. 2. Again, frame 9, housing 10 and cavity 11 are shown as previously described. Circuit membrane 6 is shown including projection 8 and rigid pad 20 formed thereon. Circuit card 1 with contact land 4, in this case shown as a dimple, can also be seen in close alignment with projection 8. Arrows 33 represent force applied to rigid pads 20 from pressurized fluid contained in cavity 11. It can be seen that the pressure is distributed on the surface of pad 20, but will be integrated and transformed into a resultant force which is applied at projection 8. Thus, the rigid pad 20 operates to resolve the distributed force exerted thereon to a single force at projection 8 to provide the high contact pressure between membrane 6 and pluggable circuit board 1. FIG. 5 also shows that rigid pad 20 is not centered with respect to projection 8, which will provide compensation for the deformation of circuit membrane 6 when the fluid in cavity 11 is pressurized. Those skilled in the art will understand that many different positions of pads 20 with respect to projections 8 can be utilized depending on the particular application. Of course, configurations of rigid pads 20 other than the rectangular shape shown in FIG. 3 are contemplated by the present invention and may be desirable in specific instances to resolve and transfer force to projections 8. For example, in a preferred embodiment a thin resilient layer of copper is left on the cavity side of membrane 6 to provide enhanced sealing characteristics, and prevent any permeation of the dielectric material by fluid in cavity 11.

Figure 6:
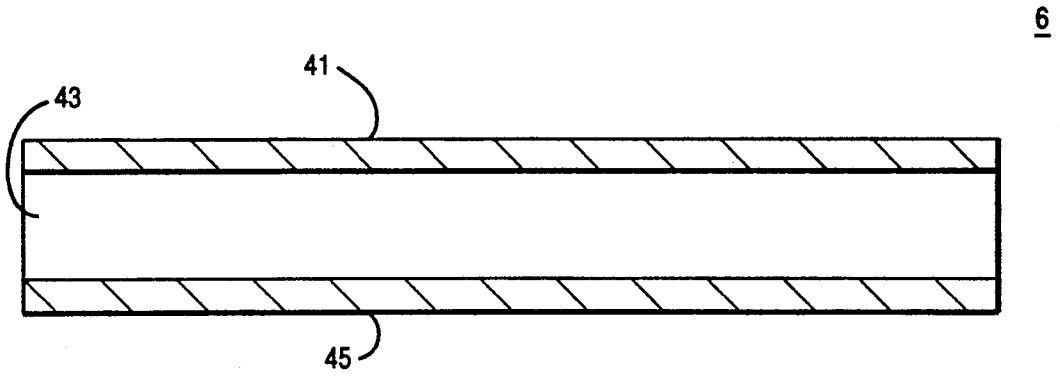
FIG. 6 is a side view of the material used to fabricate the deformable electric circuit membrane of the present invention.
Figure 7:
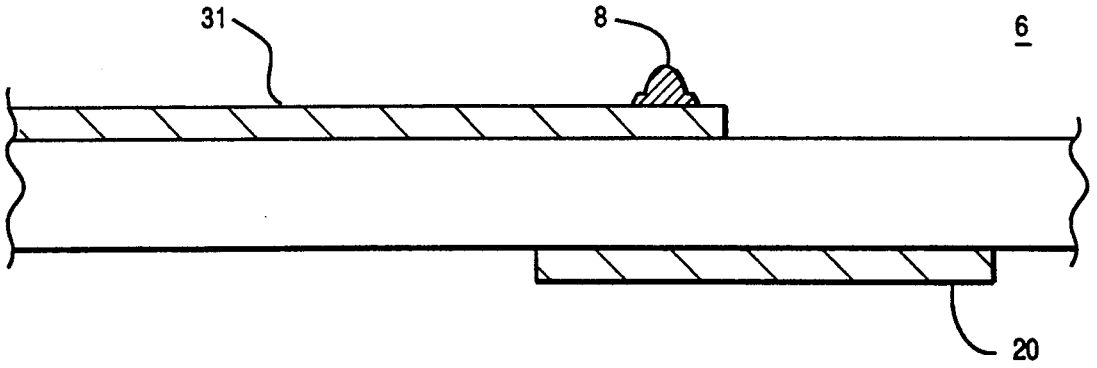
FIG. 7 is a side view of the material shown in FIG. 6 after fabrication of the circuit membrane.

FIGS. 6 and 7 will now be used to describe a representative fabrication process of circuit membrane 6. Initially, a single layer of dielectric material 43, such as a polyimide, or the like is used with an electrically conductive laminate 41, 45, on each side thereof, which may be copper invar copper (CIC), or the like. Next, the CIC laminate 41 is etched by utilizing a photoresist masking process, or the like, such that all of the material 41, except lands 31 (see also FIG. 4) is removed. Similarly, photoresist etching by use of a mask can be used to remove all of the material 45 except for rigid pads 20, as shown in FIGS. 1, 3 and 7. Finally, an electrically conductive material such as copper, or the like is deposited on land 31 in order to form projection 8. The deposition of material to form projection 8 can be accomplished by electrode deposition techniques as are known in the art.

Thus, it can be seen that by utilizing the actual electrical circuit element 6 as a deformable contact means the electrical characteristics thereof can be monitored and designed as desired. For example, electrical membrane 6 can be designed to give a controlled characteristic impedance and noise coupling coefficient, as well as including independent power connections having low inductance. Further, the configuration and design of the signal and reference lines, which are shown as lands 31, can be fabricated to provide optimal vertical spacing therebetween.

Although certain preferred embodiments have been shown and described, it should be understood that many changes and modifications may be made therein without departing from the scope of the appended claims.

What is claimed is:

1. A fluid actuated connector for electrically connecting first and second circuit cards each having a plurality of connection points thereon, comprising:

deformable electrical circuit means including an insulating membrane having a plurality of electrical contact points thereon corresponding to said first circuit card connection points and integral circuitry for electrically interconnecting said contact points to said second circuit card;

means for receiving a force; and force transfer means, in said electrical circuit means, for communicating the received force to said electrical contact points.

2. A connector according to claim 1 wherein said force transfer means comprises:

means for resolving the provided force into a resultant force; and means for providing said resolved force to said electrical contact points.

3. A connector according to claim 2 wherein said force transfer means comprises rigid pads included on a side of said electrical circuit means opposite said electrical contact points.

4. A connector according to claim 3 wherein said electrical contact points are configured as projections.

5. A connector according to claim 4 wherein said rigid pards are included on said electrical circuit means at a position substantially opposite said electrical contact points and corresponding to said contact points.

6. A connector according to claim 5 wherein said electrical circuit means is constructed from a single layer dielectric material.

7. A connector according to claim 6 wherein said receiving means comprises:

frame means for supporting said electrical circuit means and providing a sealing engagement therebetween;

a housing, surrounding said frame means, which forms a first cavity in communication with the side of said electrical circuit means including said pads and a substantially cylindrical second cavity in communication with said first cavity by way of a hole.

8. A connector according to claim 7 further comprising:

piston means, movably disposed within said second cavity for providing pressure to said deformable electrical circuit means through said hole and said first cavity;

means, movably disposed within said second cavity, for displacing said piston; and biasing means for interconnecting said displacing means and said piston such that movement of said displacing means is correspondingly transferred to said piston.

9. A method of connecting a pluggable circuit card with a main circuit board by utilizing a fluid actuated connector, said method comprising the steps of:

receiving said pluggable circuit card, with a plurality of input/output connection points thereon, in said connector;

providing deformable electrical circuit means including an insulating membrane having a plurality of electrical contact points thereon for contacting said connection points on said card;

deforming said electrical circuit means by providing force thereto;

providing force transfer means, inherent within said electrical circuit means, for receiving said force;

communicating the provided force to said electrical contact points;

contacting said electrical contact points with said input/output connection points; and electrically connecting said pluggable circuit card and said main circuit board using integral circuitry disposed on said insulating membrane.

10. A method according to claim 9 wherein said step of communicating comprises the steps of:

resolving said force, received by said transfer means, into a resultant force; and providing said resolved force to said electrical contact points.

* * * * *